US005813094A

United States Patent [19]

Perez, II

[11] Patent Number: 5,813,094

[45] Date of Patent: Sep. 29, 1998

[54] DEVICE FOR REPAIRING AN ARTICLE HAVING AN INOPERABLE SLIDABLE FASTENER OR STRINGER

[76] Inventor: Raul Marquez Perez, II, 2610 E. Sylvia, Phoenix, Ariz. 85032

[21] Appl. No.: 826,348

[22] Filed: Mar. 25, 1997

[51] Int. Cl.[6] ..... A44B 19/00

[52] U.S. Cl. ..... 24/381

[58] Field of Search ..... 29/766, 769, 402.09, 29/402.11, 402.08, 401.1, 408; 24/381, 336

[56] References Cited

U.S. PATENT DOCUMENTS

| | | | |
|---|---|---|---|
| 2,028,216 | 1/1936 | Hiering . | |
| 4,083,089 | 4/1978 | Minami . | |
| 4,130,917 | 12/1978 | Shopalovich . | |
| 5,586,807 | 12/1996 | Taggart | 24/336 X |

FOREIGN PATENT DOCUMENTS

| | | | |
|---|---|---|---|
| 992950 | 10/1951 | France | 24/381 |
| 2912285 | 10/1980 | Germany | 24/381 |

OTHER PUBLICATIONS

Brochure accompanying Zipper Rescue Kit, copyright 1993 by Mike McCabe, said kit produced by ZRK Enterprises, Inc., McCall, ID.

*Primary Examiner*—James R. Brittain
*Attorney, Agent, or Firm*—Paula L. Bentley

[57] ABSTRACT

A device comprising a slidable fastener or slidable fastener stringer affixed to a hollow channel member, wherein said channel member has an upper and a lower edge defining a longitudinal opening for receiving and holding the interlocking elements and/or a portion of the tape of a stringer belonging to an inoperable slidable fastener. The device of the present invention is used particularly to remedy the problem of an inoperable fastener already installed in the article, without removing the inoperable fastener from its article, by connecting the present invention to the old stringer/fastener thereby interposing a functioning fastener/stringer in said article between the stringers of the existing, inoperable fastener. The channel member of the present invention may have slots in its walls to increase its flexibility, may have a flange coextensive with an edge to facilitate insertion of the old stringer between said edges, or may have upper and lower edges modified to increase the ability of said edges to hold onto the old stringer.

20 Claims, 2 Drawing Sheets

DEVICE FOR REPAIRING AN ARTICLE HAVING AN INOPERABLE SLIDABLE FASTENER OR STRINGER

BACKGROUND OF THE INVENTION

The present invention pertains to the field of slidable fasteners (commonly called "zippers") and the repair thereof. In particular, the present invention is used to remedy nearly any inoperable slidable fastener, especially one that has missing or dysfunctional interlocking elements, without removing the inoperable slidable fastener from its article.

Slidable fasteners have been used for decades in a wide variety of articles including clothing, tents, luggage, bags and wallets. A slidable fastener (hence fastener) is generally comprised of a pair of juxtaposed, matable or interlockable stringers, and, depending on the construction and type of fastener, also includes one or more sliders, stops, boxes, and/or separating pins (pins) attached to one or both of its stringers. A "stringer" is a long, tape-like strand with interlocking element/s attached along one edge. Typical interlocking elements employed in a fastener include spaced apart teeth, a coil, and the tongue and groove, however, other types of interlocking elements, such as that disclosed in Shopalovich-917 discussed below, are known in the art. The interlocking element-present edges of the pair of stringers of a fastener face one another and in most cases are joined/separated by the slider that joins/separates the interlocking elements of the left stringer with/from the interlocking elements of the right stringer when the slider is moved up/down the length of the stringer pair. Fasteners employing the tongue and groove type interlocking elements may be joined/separated simply by manually pressing/pulling the tongue and groove together/apart.

In both separating and non-separating fasteners a stop and a box each function to prevent the slider from becoming completely derailed from the stringer, and may further function to keep the closed portion of a fastener below the slider from separating. Although most stops are in the form of a clamp-like member attached over the interlocking elements of one or both stringers, a stop could be effected by a large variety of other means, including stitching over interlocking elements, folding down then securing the end of a stringer, enclosing the end of a stringer(s) in a seam, fusing interlocking elements, or even securing a safety pin at the end of a stringer(s), all of which function to prevent the slider from derailing and/or keeping the lower interlocked portion from separating. In separating zippers, the pins and box enable the user to easily align the slider and two stringers in preparation for zipping up, or, to easily separate the two stringers from one another after unzipping. A fastener is installed in an article by sewing, tacking, glueing or otherwise securing the tape portion (the side without interlocking elements) of each stringer directly to both sides of the opening in which the fastener is to be positioned.

Whenever a fastener breaks down the utility or desirability of the article containing the fastener is reduced or obliterated necessitating repair or replacement of the fastener to return the article to full utility. Generally, there are three reasons why a fastener ceases to function: problems involving the slider, problems with a stop, box or pin, or problems with the interlocking elements of one or both stringers. A fastener can be directly repaired in limited circumstances, but where there is no way to directly repair an inoperable fastener, the only solution left in the art is to remove the offending fastener from the article's opening and install another fastener in the stead thereof.

Fasteners that cease to work properly due to a damaged or missing slider/stop can be directly repaired by first removing the offending slider/stop (if necessary), then either installing an operational stop/slider in the stead thereof, or, in the case of a problem with a stop, using one of the alternative stop measures disclosed supra such as whip stitching over the interlocking elements with needle and thread to form a lump of threads that act as a stop. However, these solutions require the repairer to accurately diagnose the source of fastener inoperabililty which in the case of an inoperable slider may not be obvious, and also requires the repairer to have another slider/stop of the proper size plus tools such as a screwdriver, needle, thread and/or pliers. Unlike the stop and slider, there is no known solution to replace a missing or damaged pin or box because the art requires pins and boxes to be attached to the stringer by a fastener manufacturer. Articles with separating fasteners with missing or dysfunctional pins or box must have the inoperable fastener removed and another separatable fastener installed in the article's opening.

Conventional fasteners with missing, damaged or otherwise dysfunctional interlocking elements cannot be mended at all, the only way to return the article possessing such a fastener to full utility is to remove the inoperable fastener from its article, then install another fastener in the empty opening. This process is tedious and labor intensive, often requiring the taking apart of the article to remove the offending fastener and to insert another fastener therein followed by reassembling the article. In many articles, like tents and luggage, this type of repair is economically or practically infeasible resulting in the article being discarded rather than replacing the inoperable fastener. Sometimes replacement of an inoperative fastener may be impossible because removing the inoperable fastener and installing another would destroy the article containing it. In still other situations an inoperative fastener needs to be repaired immediately, in the field, where sewing machines, thread, pliers and other implements of repair are unavailable, such as in the case when a fastener belonging to a sleeping bag or tent breaks down on a very cold night.

U.S. Pat. No. 4,130,917 (Shopalovich 1978) teaches a water tight fastener having male-female coupling elements wherein the male element is designed such that it can be easily removed then replaced. However, the Shopalovich attempt to solve the problem of zipper malfunction due to missing or damaged interlocking elements is only applicable to Shopalovich type fasteners, not to conventional zippers utilizing teeth/coil elements that are not readily interchangeable. Further, the Shopalovich type fastener does not appear to teach a replaceable female interlockable component thus, a faulty female component is not directly repairable and necessitates replacing that fastener with a functioning one. It should be apparent then, that for the vast majority of fasteners a solution for missing, damaged or otherwise inoperable interlocking elements is yet to be found in the art.

Accordingly, the art has yet to provide a remedy for conventional inoperable fasteners with missing, damaged or otherwise inoperable interlocking elements that does not involve removing the old, inoperable fastener, then sewing or bonding another, operable fastener in the stead thereof. And furthermore, the art has yet to provide a simple, single solution for the non-expert to remedy any inoperable fastener regardless of the cause of inoperability.

SUMMARY OF THE INVENTION

The present invention involves a device for repairing virtually any article having an inoperable fastener by essentially interposing a functional fastener/stringer between the stringers of the inoperable fastener. The new fastener/stringer is positioned in parallel proximity to the old fastener/stringer with the assistance of a channel member affixed to or otherwise integrated with the new fastener/stringer member. Henceforth, the term "new fastener/stringer" and "old fastener/stringer" is hereinafter used to distinguish the fastener/stringer integrated with or affixed to the channel member of the present invention (the "new fastener/stringer") from the inoperable fastener/stringer belonging to the article that is in need of repair (the "old fastener/stringer"); and, the term "affix" means to attach to or be integral with.

Generally, the present invention involves affixing the tape portion of a stringer member (hence stringer) to a channel member in such a way that the new stringer's interlocking element-present edge is sufficiently free from the channel member and the mode of attachment to the channel member that the new stringer is unimpeded during fastener operation. The stringer tape portion may be affixed to the channel member by any suitable means of attachment including sewing, glueing, bonding, welding, fusing, and tacking.

The channel member of the present invention is an elongate, substantially hollow member having a hollow core area and a longitudinal narrow opening. The narrow opening is bordered by opposing upper and a lower edges and is adapted for receiving and holding fast a stringer by its interlocking element-present edge. The channel member is preferably made of a material, such as plastic, that is flexible or resilient enough to permit the lower and/or upper edges to be pried apart to widen the longitudinal opening sufficiently far to admit the entry of the interlocking element portion of an old stringer into the hollow core, yet not so flexible that the edges are not capable of returning to their original or near original position. In this way, the upper and lower edges hold an old stringer fast by compressing the tape of the old stringer just behind the interlocking elements, and/or, by trapping the interlocking elements and resisting their withdrawal from the hollow core.

The channel member may be further adapted to facilitate the insertion of the old stringer into the channel by including a flange portion coextending from an edge of the opening. The flange portion can be unbroken or can be "fringed." The term "fringed" means to have a plurality of contiguous projections and may or may not include a visible space between the projections. Thus, the projections of a fringed flange may be spaced apart and appear comb-like or may be touching or nearly touching and appear keyboard-like. The upper and/or lower edges of the channel member may be adapted to increase their ability to hold onto the old stringer tape, and/or, to increase their ability to trap the interlocking elements of the old stringer. These adaptations may include curving either or both edges inward, making the edges sharp, changing the positions/shapes of the edges and/or channel member body to increase the pressure the edges exert on or against the old stringer, and/or a combination of these adaptations. The term "sharp" can mean thin edged or having points.

It should be apparent that because use of the device of the present invention effectively interposes a new fastener between the stringers of an old fastener, actually using the old fastener as a substrate, the device of the present invention dispenses completely with the inconvenience of removing the old fastener from and installing a new fastener/stringer in an article's opening. This means, for some articles, there may be no need to take the article with the inoperable fastener to a seamstress, luggage repairman or other specialist. And even further, the present invention does not require the user to accurately diagnose the cause of inoperation or possess tools, the proper parts or skills associated with the direct repair of an inoperable fastener because the present invention can effectively remedy virtually any dysfunctional fastener regardless of type of article, location in the article, type of fastener, or cause of fastener inoperation without such tools, parts, diagnosis or mending skills. Finally, the present invention makes it possible to quickly repair the article having an inoperable fastener in the field where tools and/or expertise are absent such as the situation where a zipper in a tent or sleeping bag becomes inoperable on a cold night, or where the zipper of a suitcase malfunctions while traveling. Never before has remedying an inoperable fastener been so simple to use and quick to implement.

It should be evident that while the description of the device of the present invention disclosed above involves affixing a right and left channel member to a new fastener, the present invention also includes a single new stringer affixed to a single channel member without necessarily including a stop, slider, pin or box on the new stringer. While generally it may be more aesthetically pleasing and simpler to use the present invention to interpose an entire new fastener in place of the inoperable old one, the present invention may be used to operationally interpose only one new stringer in an old fastener where only one stringer is needed or desired. For example, the single stringer and channel member embodiment of the present invention could be used to remedy an inoperable non-separating fastener by connecting a new stringer-channel member, having interlocking elements of a compatible size and type, to just one of the old stringers. A slider then would be positioned on the new stringer and old stringer now opposing the new stringer to slide over their respective interlocking elements. This slider could be the slider that belonged to the old fastener, or another. Although the new-old stringer duo and slider just described can function without more to close the opening of the article which contains the same, it is preferable to add an end stop at the bottom of the new-old stringers and a stop at the top of the new stringer to prevent slider derailment and separation below the slider.

Accordingly, it is a prime objective of the present invention to provide an improved and novel device for remedying an inoperable slidable fastener without the need for removing the fastener from its article.

A further object of the present invention is to provide a novel device for remedying an inoperable slidable fastener that is simple to use regardless of cause of fastener dysfunction.

Still another object of the present invention is to provide a new device with which to remedy a slidable fastener or stringer with missing, damaged or otherwise inoperable interlocking elements.

These and still further objects as shall hereinafter appear are fulfilled by the present invention in a remarkably unexpected manner as will be readily discerned from the following detailed description of exemplary embodiments thereof.

DESCRIPTION OF THE PREFERRED EMBODIMENTS

Figure 1:
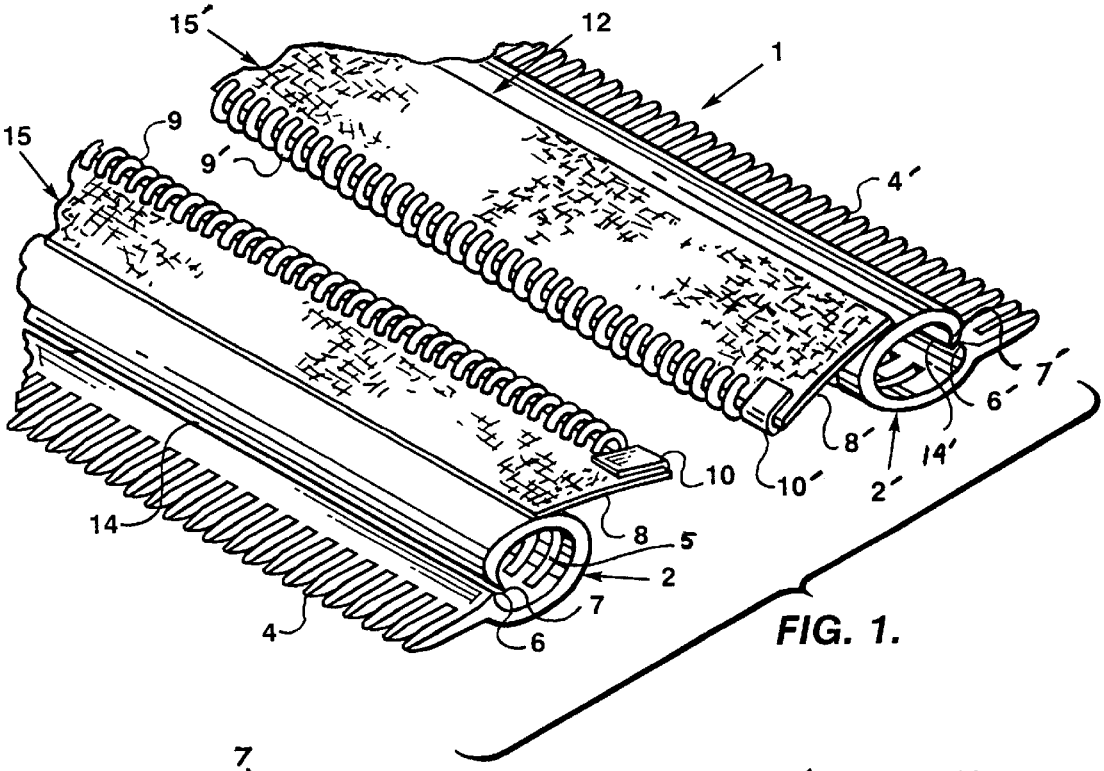
FIG. 1 is a perspective view of a first embodiment of the device of the present invention having a non-separating fastener affixed to a right and a left slotted channel member with fringed flange.
Figure 2:
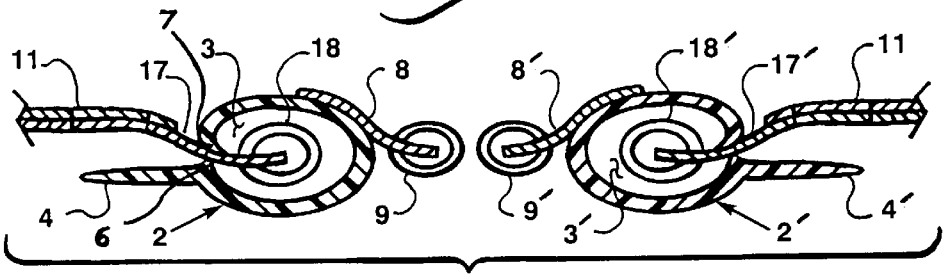
FIG. 2 is a cross section of said first embodiment in use taken along line 2 in FIG. 3.
Figure 3:
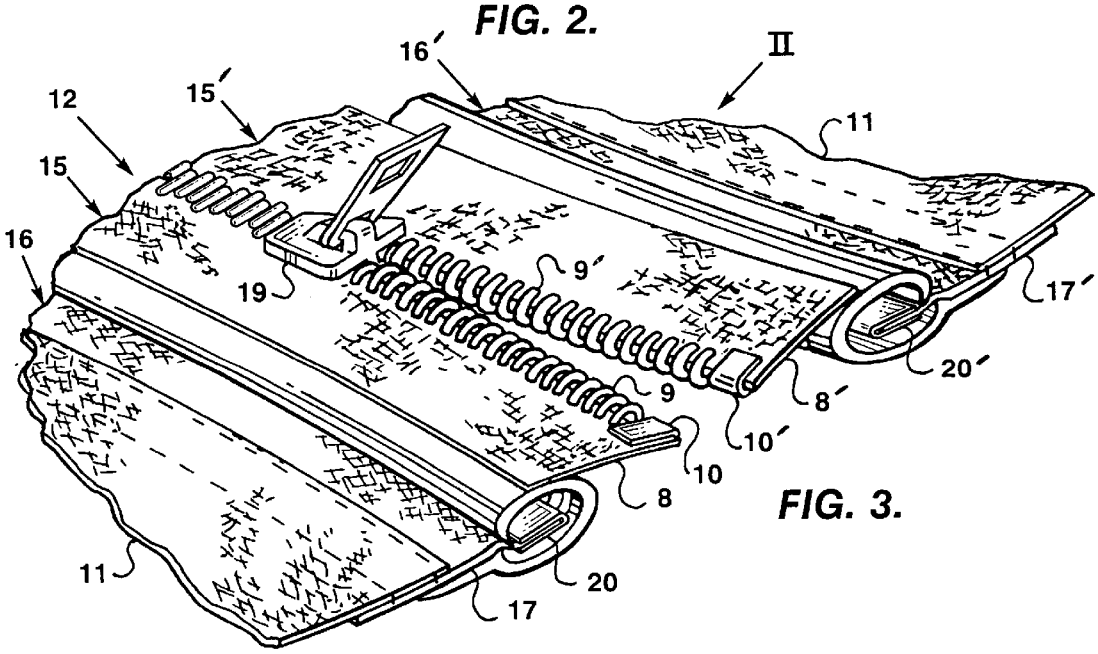
FIG. 3 is a perspective view of the top portion of said first embodiment shown here in use in an article.
Figure 3A:
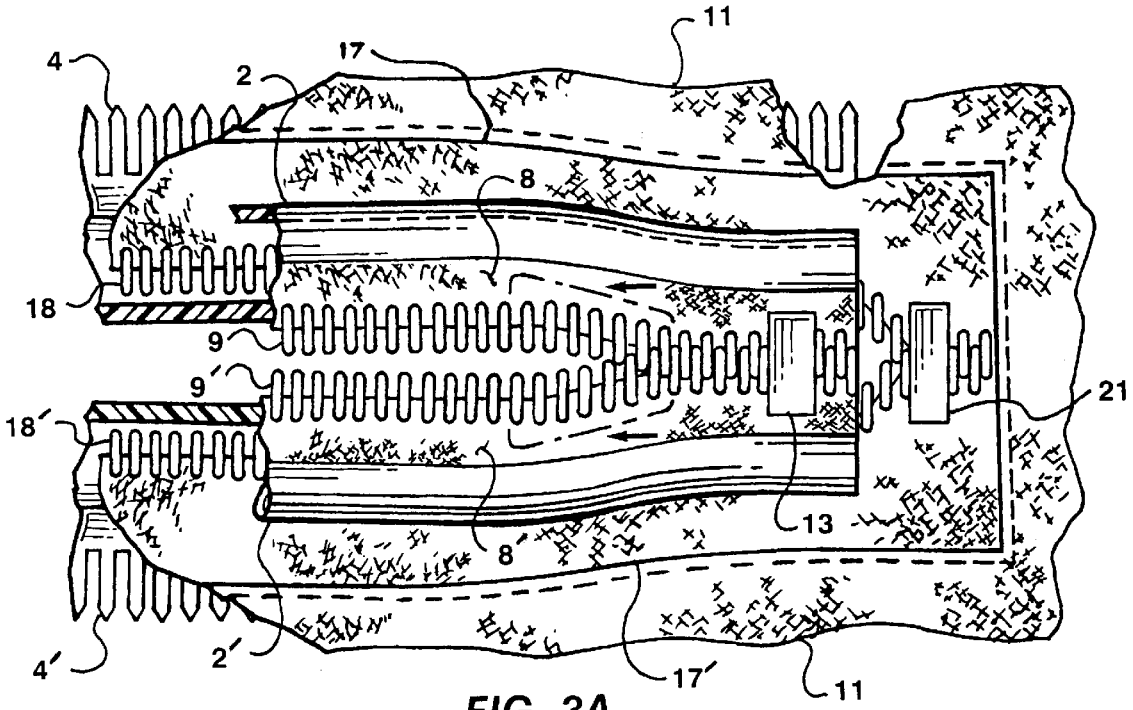
FIG. 3A is a plan view of the bottom portion of said first embodiment in use in the article of FIG. 3.
Figure 4:
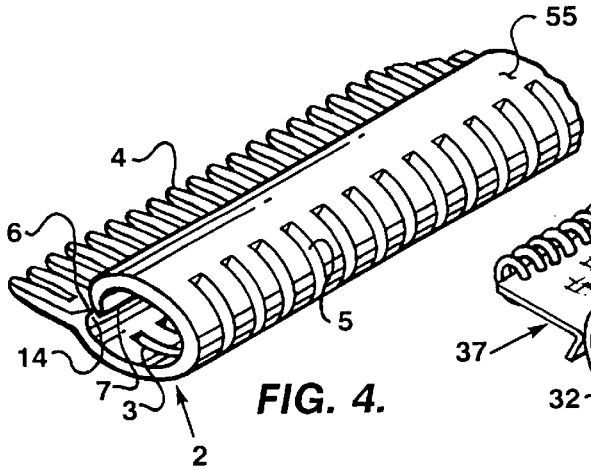
FIG. 4 is an isolated view of a channel member of said first embodiment.

Referring now to FIGS. 1, 2, 3, 3A, and 4, herein is disclosed a first preferred embodiment 1 of the present invention. Comprising said first embodiment 1 is a new fastener 12 having a left and a right stringer 15, 15' with tape portions 8, 8' firmly affixed with adhesive or other means to the respective tops of a left and a right channel member 2, 2', such that channel members 2, 2' are reciprocally positioned on opposite sides of fastener 12 and slider 19 freely slides along stringers 15, 15', as shown. Tape portions 8, 8' have, respectively, stops 10, 10' and coils 9, 9' as shown. End stop 13 is positioned across the ends of both stringers 8 and 8' as shown. To more completely disclose the construction of channel members 2 and 2', channel member 2 is now disclosed in detail detached from tape portion 8. Referring to FIG. 4, channel member 2 comprises a substantially tubular or round wall defining a hollow core 3 and a narrow longitudinal opening 14 (opening 14 is best viewed in FIG. 1) bordered by a lower ridge shaped edge 6 and an upper inwardly tapered and curved edge 7. Channel member 2 further includes an integral fringed flange 4 extending approximately 0.125 of an inch outward from lower edge 6 as shown with approximately 2 comb-like projections per 0.125 inch of longitudinal flange length. The wall of channel member 2 also includes a plurality of spaced apart slots 5 in the channel wall opposite opening 14 reserving a region 55 of channel member 2 on which to adhere said tape portion 8. Channel member 2 is preferably made of flexible plastic using conventional manufacturing methods but could be made with any other material or combination of materials that lends longitudinal flexibility to channel 2.

Referring now to FIGS. 2, 3 and 3A, herein is described how to use said first preferred embodiment to remedy an inoperable old fastener already installed in an article 11 having a left and a right old stringer 16, 16' respectively having tape portions 17, 17', coils 18, 18', and top stops 20, 20', and, end stop 21 positioned across both old stringers 16 and 16' as shown. First, left and right stringers 16, 16' of said old fastener are separated where they are not already separated and the old fastener slider (not depicted) preferably removed. Left coil 18 is manually forced between channel member edges 6 and 7 and through opening 14 of left channel member 2 until coil 18 and stop 20 occupies hollow core 3 and tape portion 17 is compressed between edges 6 and 7. Right stringer 16' is likewise inserted into channel member 2' until the end of new fastener 12 is located as close to old end stop 21 as possible. It should be evident that the resilience of the flexible channel member wall enables edges 6/7 and 6'/7' to spring back after the insertion of coils 18, 18' and compress tape portions 17, 17' as best shown in FIG. 2 Further, edges 6/7 and 6'/7' may also catch onto coils 18/18' and/or stop 20/20'. Thus, the compression and/or the catch actions of edges 6/7 and 6'/7' effectively hold fast the old stringers 16/16' in parallel proximity respective to the stringers 8/8' of fastener 12. It should be further evident that the size of hollow core 3/3' should be at least large enough to physically accommodate coil 18/18' and may be larger so as to accommodate a larger range of interlocking element sizes. Although the new fastener of the present invention and the old fastener being remedied depicted in FIGS. 1–4 are both non-separating fasteners with coils, it should be evident that either/both the new fastener or/and the old fastener could be a separating fastener or could possess interlocking elements other than coils.

Figure 5:
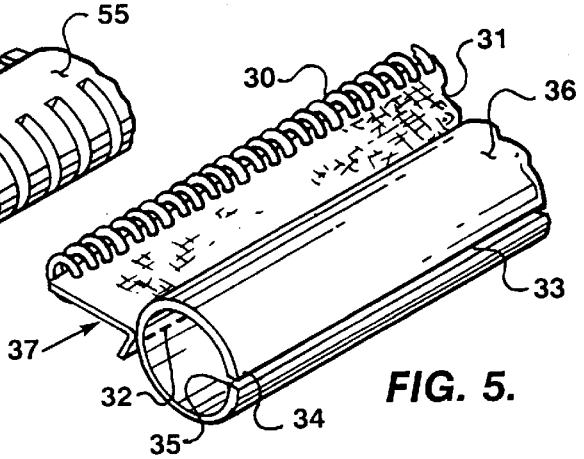
FIG. 5 is a perspective view of a representative portion of a second embodiment of the present invention.

The shape and size of the channel member of the present invention, the mode of attachment of the stringer to the channel member, and the location on the channel member where the new stringer is attached can vary widely. Referring now to FIG. 5, a representative portion of a second preferred embodiment of the present invention is shown. Said second preferred embodiment comprises a new fastener having its left and right stringers affixed to respective channel members comparable to that relating to said first embodiment disclosed above. FIG. 5 shows in detail right channel member 36 and right stringer 37 of said second embodiment. Channel member 36 is a cylindrical, flexible plastic tube having a longitudinal opening 33 bordered by upper edge 34 and lower edge 35. Stringer 37 has tape portion 31 and coil 30, wherein tape portion 31 of stringer 37 is affixed with stitching 32 to the outer surface of tube 36 by spreading apart edges 34 and 35 and sewing through tube 36 and stringer 37, as shown. This second embodiment could be further modified to improve its overall flexibility for use in some applications, such as remedying an old fastener belonging to luggage, by providing slots/spaces in the wall of tube 36 in the wall areas, top and/or bottom, that are unoccupied by stitching 32.

Figure 6:
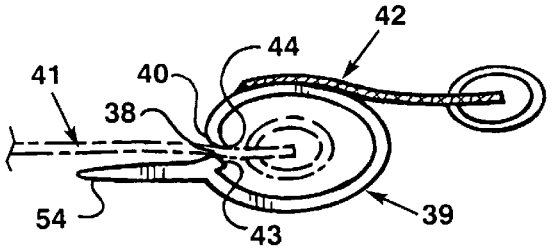
FIG. 6 is a cross section of a representative portion of a third embodiment of the present invention.

Referring now to FIG. 6, a cross sectional view of a representative portion of a third preferred embodiment is shown. Said third preferred embodiment comprises a fastener having right and left stringers affixed to respective flanged channel members comparable to said first preferred embodiment above. FIG. 6 shows in cross sectional detail a left channel member 39 and left stringer 42 of said third preferred embodiment. Channel member 39 includes a flange 54, an upper edge 40, and a lower edge 43 bordering longitudinal opening 38. Upper edge 40 is in the form of a plurality of inwardly curved teeth like points 44 (only one of which is visible in this cross sectional view) for piercing into the tape portion of an old stringer 41 when in use. Lower edge 43 is in the shape of an inwardly directed ridge that further enables said third embodiment to hold old stringer 41 fast in place in channel member 39 when in use. Flange 54 is fringed and also tapered so as to become thinner as it extends away from said edge 43. Channel member 39 is slotted, comparable to that depicted in FIG. 4. New stringer 42 is affixed with an adhesive to the top portion of channel member 39 as shown.

Figure 7:
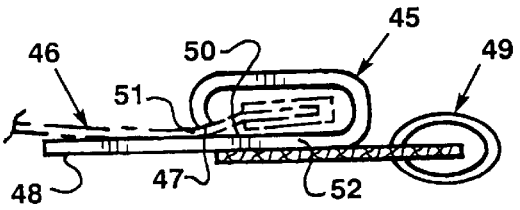
FIG. 7 is a cross section of a representative portion of a fourth embodiment of the present invention.

FIG. 7 shows a in cross sectional view of a representative portion of yet another preferred embodiment comparable to the previous embodiments, comprising a new fastener having its right and left stringers affixed to the underside of respective channel members. FIG. 7 shows in cross sectional detail a left channel member 45 and left stringer 49 of said fourth preferred embodiment. Channel member 45 is a boxy in shape and has an upper edge 47, a flattened wall portion 48, and a flange 52 coextensive with wall portion 48 as shown. A flat lower edge 50 (here actually merged with flange 52 and occupying a linear area of flange 52 and/or wall portion 48 opposite upper edge 47) together with upper edge 47 define a longitudinal opening 51 in which an old stringer 46 can be inserted and held in a similar manner as that described for the embodiments above. New stringer 49 is strongly adhered to the underside of said flattened wall portion 48 of channel member 45 as shown. The channel members of this embodiment can likewise be further modified to include slots in the channel member wall(s) and/or a fringed flange in a manner similar to that heretofore disclosed.

It should be evident that the new stringers in all of the embodiments above are attached to the respective channel members such that the interlocking element portion of the stringer is operationally unencumbered by the channel member. It should be further evident that the fasteners utilized in the present invention may be separating or non-separating.

It should also be apparent that due to the versatility of the fastener and fastener repair art that the present invention includes simple embodiments comprising a stringer affixed to a channel member constructed in a similar manner as the embodiments including a fastener taught and described above. This simple embodiment has several possible uses including as a component used to repair an article with an inoperable old fastener having only one dysfunctional stringer with missing or damaged interlocking elements by attaching said simple embodiment having interlocking elements that are matable to the interlocking elements of the remaining stringer of the old fastener to said dysfunctional stringer, then securing a slider, stop, box, and/or pin, or equivalent measure, as needed, to the new stringer of said simple embodiment to result in an article having an operable fastener made of new and old components. Plainly, two of said simple embodiments, one having interlocking elements that are matable with those of the other, could also be used to similarly remedy an inoperable fastener having two dysfunctional stringers.

Another embodiment, intended to be cut-to-length and used as a component for repairing an article with an inoperable fastener, or, for in field/emergency repairs where tools are limited or unavailable, comprises a pair of interlockable stringers affixed respectively to a pair of channel members, a slider joining said stringers, and an end stop (for non-separating fastener result), or alternatively, pins and box (for a separating fastener result), secured to the bottom ends of said stringers. These cut-to-fit embodiments are especially useful in repairing tents and sleeping bags with broken fasteners. It should be evident that after the instant embodiment is cut to the desired length it may be desirable to effect a stop at the top end of one or both new stringers to prevent slider derailment when zipping up.

Finally, even though the present invention is especially applicable for remedying an inoperable stringer/fastener already installed in any article, including clothing, tents, luggage, bags, and wallets, without removing the inoperable stringer from its article, the present invention could be used as a way to simply substitute a fastener of a desired size/type for a fastener of undesired size/type.

From the foregoing, it is readily apparent that a useful embodiment of the present invention has been herein described and illustrated which fulfills all of the aforestated objectives in a remarkably unexpected fashion. It is of course understood that such modifications, alterations and adaptations as may readily occur to the artisan confronted with this disclosure are intended within the spirit of this disclosure.

What is claimed is:

1. A device for use in repairing an article with an inoperable slidable fastener, comprising:

a channel member having an upper edge and a lower edge defining a narrow longitudinal opening, wherein said opening is adapted to receive and hold a workpiece stringer; and a stringer having an outer tape portion, said outer tape portion of said stringer affixed to said channel member.

2. The device according to claim 1, wherein at least one of said upper and said lower edge is curved inward.

3. The device according to claim 2, wherein said channel member comprises a substantially round continuous wall terminating at said upper and said lower edge, wherein said upper and said lower edges are curved inward, wherein said channel member wall is slotted, and wherein said channel member further includes a fringed flange integral with said round wall and extending out from said lower edge.

4. The device according to claim 1, further including a flange extending out from said lower edge.

5. The device according to claim 4, wherein said lower edge is flat so as to merge with said flange.

6. The device according to claim 4, wherein said flange is fringed.

7. The device according to claim 4, wherein said flange is tapered to become thinner as said flange extends outward.

8. The device according to claim 1, wherein said channel member is slotted.

9. The device according to claim 1, wherein at least one of said upper and said lower edge is sharp.

10. The device according to claim 1, wherein said channel member is made of flexible plastic and substantially tube shaped, and wherein said stringer tape portion is affixed by sewing said stringer tape portion to said channel member.

11. A device for repairing an article having an inoperable slidable fastener, comprising:

a first channel member having a first upper edge and a first lower edge defining a first longitudinal opening, and, a second channel member having a second upper edge and a second lower edge defining a second longitudinal opening, wherein said first and said second longitudinal opening are adapted to receive and hold, respectively, a first and a second workpiece stringer; and a slidable fastener comprising a first stringer, a second stringer interlockable with said first stringer, and at least one of the members selected from the group consisting of a slider, a stop, a box, and a pin, said first and said second stringer each having an outer tape portion;

wherein said tape portions of said first stringer and said second stringer are affixed respectively to said first channel member and said second channel member.

12. The device according to claim 11, wherein at least one of said upper edge and said lower edge of each of said first channel member and said second channel member are curved inward.

13. The device according to claim 11, wherein said first channel member further includes a first flange extending outward from said first lower edge, and wherein said second channel member further includes a second flange extending out from said second lower edge.

14. The device according to claim 13, wherein said first flange and said second flange are fringed.

15. The device according to claim 13, wherein said first lower edge is flat so as to merge with said first flange, and wherein said second lower edge is flat so as to merge with said second flange.

16. The device according to claim 13, wherein said first flange and said second flange are tapered to become thinner respectively as said first flange and said second flange extends outward.

17. The device according to claim 11, wherein said first channel member and said second channel member are slotted.

18. The device according to claim 11, wherein at least one of said edges belonging to each of said first channel member and said second channel member are sharp.

19. The device according to claim 11, wherein said first channel member and said second channel member are each substantially cylindrical and made of flexible plastic; and wherein said first stringer tape portion and said second stringer tape portion are sewn respectively to said first channel member and said second channel member.

20. A device used to repair an article with an inoperable slidable fastener, comprising:

a first channel member and a second channel member each having a round wall terminating in an upper and a lower inwardly curved edge defining a longitudinal opening, wherein said first and said second opening are adapted to receive and hold, respectively, a first and a second workpiece stringer, each of said walls having a plurality of slots therein and a fringed flange integral with said channel member and extending outward from said lower edge; and a slidable fastener comprising in assembly a first stringer, a second stringer interlockable with said first stringer, and at least one of the members selected from the group consisting of a slider, a stop, a box, and a pin, said first stringer and said second stringer each having an outer tape portion;

wherein said outer tape portions of said first stringer and said second stringer are affixed respectively to said first channel member wall and said second channel member wall such that said first channel member and said second channel member are reciprocally positioned on opposite sides of said fastener.

* * * * *